United States Patent [19]

Goodden

[11] 4,280,645

[45] Jul. 28, 1981

[54] HARNESS FOR LIFTING HEAVY OBJECTS

[76] Inventor: Dennis D. Goodden, 11525 NW. 76th St., Parkville, Mo. 64152

[21] Appl. No.: 117,112

[22] Filed: Jan. 31, 1980

[51] Int. Cl.[3] ..... A45F 3/14

[52] U.S. Cl. ..... 224/259; 224/266; 224/267; 294/25

[58] Field of Search ..... 224/45 R, 209, 218, 224/219, 222, 259, 260, 264, 265, 266, 267; 294/15, 25, 26

[56] References Cited

U.S. PATENT DOCUMENTS

| | | | |
|---|---|---|---|
| 87,844 | 3/1869 | Hale | 224/209 X |
| 356,846 | 2/1887 | Martin | 224/222 X |
| 1,281,822 | 10/1918 | Orr | 224/266 X |
| 1,428,285 | 9/1922 | Herbert | 224/45 R X |
| 1,574,927 | 3/1926 | Otto | 294/25 X |
| 1,836,545 | 12/1931 | Normand | 294/26 X |
| 2,358,551 | 9/1944 | Beaton | 224/259 |
| 2,546,113 | 3/1951 | Spang | 224/45 R X |
| 2,718,988 | 9/1955 | Potts | 224/264 X |
| 3,850,467 | 11/1974 | Johnson | 294/25 X |

FOREIGN PATENT DOCUMENTS

| | | | |
|---|---|---|---|
| 148283 | 9/1952 | Australia | 224/267 |
| 962373 | 6/1950 | France | 224/266 |

*Primary Examiner*—Stephen Marcus

*Attorney, Agent, or Firm*—Lowe, Kokjer, Kircher, Wharton & Bowman

[57] ABSTRACT

A harness for lifting heavy and bulky objects is the subject of this invention. The device provides for better lifting ability through superior load distribution and also provides for greater protection for the hands and arms of the person doing the lifting. A yoke type shoulder harness substantially spans the distance between the shoulders of the person wearing it while also circumscribing the neck area. Straps depend from the shoulder harness and are coupled with a rigid L-shaped support. The vertical leg of the L-shaped support substantially spans the distance between the hand and the elbow. The horizontal leg of the L-shaped support presents an enclosure having an opening for receiving at least a portion of the hand. A highly frictional covering on the upper surface of the horizontal leg holds objects in place. The strap means which couples the L-shaped supports with the shoulder harness includes buckle means for adjusting the effective length of the device.

5 Claims, 4 Drawing Figures

HARNESS FOR LIFTING HEAVY OBJECTS

SUMMARY AND BRIEF DESCRIPTION OF THE INVENTION

This invention relates generally to equipment for lifting heavy objects and more particularly to a device adapted to be worn by an individual to provide maximum lifting ability in the safest possible manner.

It has long been known that man's lifting ability is maximized when the load is carried from the back. Various harness type devices have been employed for this purpose. Exemplary of the prior art constructions are those disclosed in U.S. Pat. Nos. 1,727,873 to Farmer and 707,610 to Moeller. Another device for carrying sheets of building material is disclosed in U.S. Pat. No. 2,651,441 to Rau et al.

All of the devices of the prior art are characterized by a strap type harness which fastens over the shoulders and some type of hooks which are secured to the straps. While all of the prior art devices are helpful in carrying moderate loads and particularly those which are not of an unusually large volume, none of the devices are particularly designed for extremely heavy loads and ones of large volume.

In the case of extremely heavy and bulky loads, even though an individual may be able to physically lift the load, strain may be placed on the hands or forearms where lifting contact is made. Oftentimes, the point tension as a result of a sharp edge or corner of the object bearing against the forearm will be the limiting factor in how long the object may be carried. Another problem in carrying extremely heavy objects is that the hands may be pinched or otherwise hurt if they strike a stationary object.

It is therefore an object of the present invention to provide a device for lifting heavy objects which has greater stability than previous lifting harnesses as a result of a rigid support which extends along the forearm.

Another object of the invention is to provide a lifting device having a harness and lifting hooks with an integral arm circumscribing collar so as to keep the arms of the individual engaged with the lifting hooks.

Another important aim of the invention is to provide a lifting device which employs a yoke construction which extends substantially from shoulder to shoulder thereby maximizing weight distribution over the back of the person lifting the object.

An objective of the invention is also to provide a lifting device which incorporates a hand shield to avoid any possibility of the hand becoming pinched, bruised or cut from contact with the stationary object.

Still another important aim of the invention is to provide a lifting device as described in the foregoing objects which incorporates a rigid forearm support so as to protect the forearm against stress points resulting from contact with the object being lifted.

An objective of the invention is also to provide a lifting device as set forth in the above objects which is adjustable and also economical to construct.

Other objects of the invention will be made clear or become apparent from the following description and claims when read in light of the accompanying drawing wherein:

Figure 1:
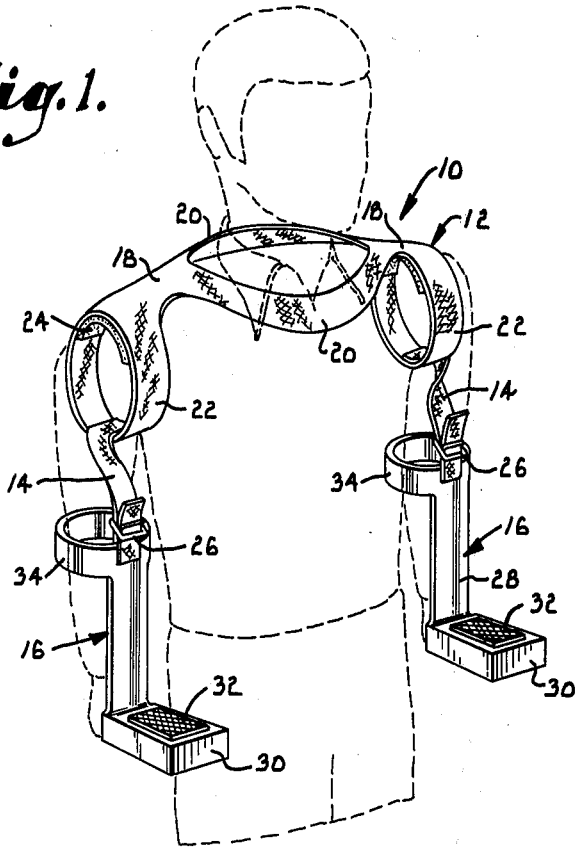
FIG. 1 is a perspective view of the device according to the present invention.

Referring to the drawings, the device of the present invention is designated generally by the numeral 10 and comprises a yoke portion 12, a pair of straps 14, and two rigid L-shaped supports designated generally by the numeral 16.

Yoke 12 is formed from a woven fabric type material and includes shoulder spanning sections 18 which are integral with and merge into neck circumscribing sections 20. Also integral with the shoulder spanning sections 18 are strap extensions 22 which are designed to pass around the arm of the individual wearing the device in the area of the arm and shoulder socket. A strip of rubber padding 24 is secured along the inside of strap extension 22 in the area overlying the arm socket.

Each of the straps 14 is secured to a respective strap extension 22 and then passes through an opening in a corresponding rigid support 16. A buckle 26 for each of the straps provides means for adjusting the effective length thereof.

Each of the rigid supports 16 is identical and hence only one will be described in detail. Each support 16 comprises a vertical leg 28 which is generally planar and substantially spans the distance between the hand and the elbow of a person using the device. Integral with and extending at an angle of 90° or less from the vertical leg is a generally horizontal leg 30. Horizontal leg 30 presents an enclosed housing having an opening **30*a* for receiving at least the forward portion of a hand. The lifting surface of horizontal leg 30 is provided with a highly frictional covering 32. It is to be noted that the inside of housing 30 is provided with a recessed area 30*b*** so as to provide a surface against which the fingers may grasp.

At the upper end of vertical leg 26 is an integral sleeve 34 which is designed to completely circumscribe the arm in the vicinity of the elbow.

Figure 2:
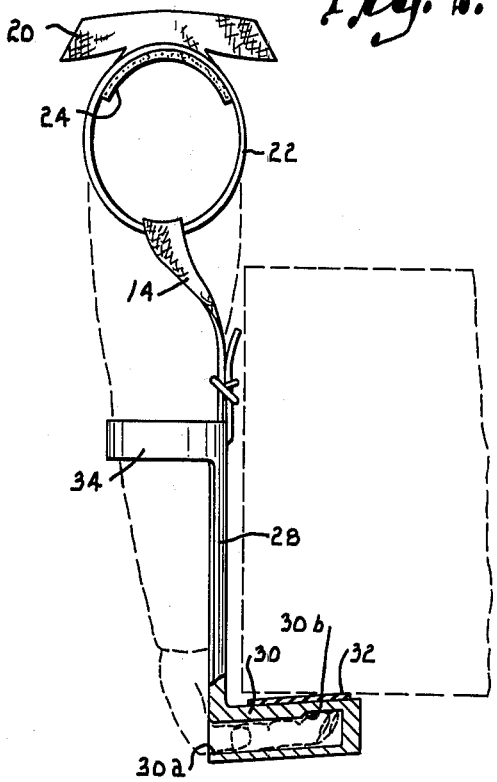
FIG. 2 is an elevational view of the device shown in FIG. 1 being used to lift an object.
Figure 3:
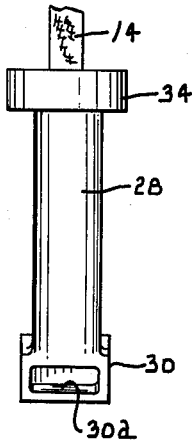
FIG. 3 is an enlarged rear elevational view of the L-shaped lifting member of the device.
Figure 4:
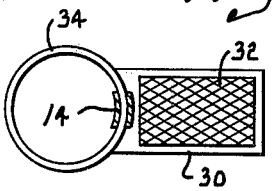
FIG. 4 is a horizontal cross-sectional view illustrating the rigid lifting member of the device in top plan.

In use, the device is placed over the shoulders and around the arms in the manner illustrated in FIG. 1. If desirable to facilitate placement and removal of the device, one or more snap fittings may be provided in the yoke 12. It is to be noted that the generally flat, shoulder-spanning design of yoke 12 assures maximum distribution of weight over the shoulder area and to the back of the person wearing the device. The arms of the person are placed through sleeves 34 and the hands are inserted in openings **30*a* of horizontal legs 30. The individual may then place the horizontal legs under an object such as is indicated in broken lines in FIG. 2. The vertical leg 28 which substantially spans the entire distance of the forearm protects this area from pinching or other tension forces against it by the object being lifted. The hands of the individual are also protected by virtue of being within enclosure 30. Since sleeves 34 hold supports 16 against the arms, the possibility of the object being lifted becoming imbalanced is reduced. Even if one hand is removed from enclosure 30 to open a door or gate, the support 16** will readily maintain its position holding the object.

The device of the invention is particularly useful when carrying objects through doorways or other confined areas where the hands could strike a wall or door frame and be pinched or bruised. Because of the placement of the hands within enclosure 30, they are substantially protected and yet the enclosures do not interfere with passage of the object through the dooway since they are placed underneath the object.

I claim:

1. A device for assisting a person in carrying heavy objects which avoids direct loading of the wrist area, said device comprising:

means for placement over the shoulders of the person;

plural strap means for depending from said over the shoulder means, said strap means being in general alignment with the arms of the person;

a rigid generally L-shaped support coupled with each of said strap means, each of said supports being characterized by a generally vertical leg of a length substantially spanning the distance between the hand and the elbow and another leg comprising an enclosure having an opening for receiving at least a portion of the hand; and a sleeve integral with each of said supports and adapted to receive and enclose the arm in the vicinity of the elbow.

2. The invention of claim 1, wherein said sleeve is disposed at the top of said vertical leg.

3. The invention of claim 1, wherein the load supporting surface of said other leg is provided with a high frictional covering.

4. The invention of claim 1, wherein said means to be positioned over the shoulders comprises a yoke and a strap extension at each end of said yoke for passing around the arm of the person at the arm and shoulder socket.

5. The invention of claim 4, wherein each of said strap means includes buckle means for adjusting the effective length thereof.

* * * * *